United States Patent [19]

Reynolds et al.

[11] Patent Number: 4,865,480

[45] Date of Patent: Sep. 12, 1989

[54] DISPENSER FOR MEDICAMENTS IN MELTABLE FORMULATIONS

[75] Inventors: Valdon G. Reynolds, Bountiful; Steven M. Wood, Orem; Joseph T. Sorenson, Salt Lake City, all of Utah

[73] Assignee: Sorenson Development Incorporated, Salt Lake City, Utah

[21] Appl. No.: 75,523

[22] Filed: Jul. 20, 1987

[51] Int. Cl.[4] ..... B43K 21/08; A61M 35/00

[52] U.S. Cl. ..... 401/175; 401/74; 401/83; 401/174; 604/311

[58] Field of Search ..... 401/175, 53, 68, 70, 401/74, 75, 171, 172, 174, 175, 80, 83, 84, 86, 87; 222/390, 153; 604/310, 311

[56] References Cited

U.S. PATENT DOCUMENTS

| | | | |
|---|---|---|---|
| 1,374,294 | 4/1921 | Fisher et al. | 401/175 |
| 1,609,479 | 12/1926 | Loeben | 222/390 X |
| 1,904,612 | 4/1933 | Bramson | 401/175 |
| 4,521,127 | 6/1985 | Tomburo et al. | 401/175 X |
| 4,580,920 | 4/1986 | Schmidt | 401/175 |

FOREIGN PATENT DOCUMENTS

| | | | |
|---|---|---|---|
| 3118893 | 11/1982 | Fed. Rep. of Germany | 401/68 |

*Primary Examiner*—Richard J. Apley
*Assistant Examiner*—Franklin L. Gubernick

[57] ABSTRACT

An applicator for dispensing metered amounts of medicaments in stick formulations is comprised of a hollow tube and a piston mounted to slidingly move within the tube. A finger operable base is rotatably mounted at one end of the tube and is mechanically linked by a screw member to the piston to urge the piston towards the other end of the tube. A depressible thumb piece is associated with the rotatable base. An extension or post is associated with the thumb piece to extend inward of the tube and to register with a race formed inside the tube. The race has a series of detents with which the extension may register upon rotation of the base. Registration between the extension and the detents signals certain increments of rotation or prevents further rotation of the base. The thumb piece is depressed inward to bring the extension out of registration with the detents. A medicated formulation is disposed within the tube such that the piston urges the formulation towards the other end of the tube to extend an incremental amount of the formulation beyond the open end of the tube to be applied directly to the user.

16 Claims, 4 Drawing Sheets

DISPENSER FOR MEDICAMENTS IN MELTABLE FORMULATIONS

BACKGROUND OF THE INVENTION

1. Field

The present invention relates to applicators for medicaments in stick formulations, and is more particularly directed to providing metered amounts of such formulations upon operation of a finger operable device.

2. State of the Art

Various substances are designed for topical use. That is, they are placed upon some portion of the outer surface of the body, and by some means, are caused to be adhered to or absorbed within the skin of the patient. Typical examples are liquids or lotions which are dispensed from a container onto the skin and are then rubbed into the skin with the fingers or hands. Substances of this type may be dispensed in liquid form with a roll-on applicator, such as is common with antiperspirants. Certain other such substances are commonly dispensed in "stick" form, such as is the case with lip balm and certain stick antiperspirants. This "stick" typically comprises a pillar of solid, waxy or semisolid substance dispensable, e.g. by means of a piston, from a tube. The substance typically is soft or melts at body temperature.

Certain topical medicaments may require more precise dosages than that which may be obtained by conventional topical application devices. Such medicaments may include drugs or other substances which in certain dosages have adverse side effects. For example, a solution containing minoxidil, used topically to stimulate hair growth, if used in greater quantities than prescribed, may result in reactions such as reduction in blood pressure, rapid heart rate (palpitations), weight gain, swelling, dizziness, pain, or indigestion.

Use of the hands or fingers in rubbing a substance into the skin is undesirable in circumstances in which the substance is potentially toxic or otherwise presents a hazard. In addition, waste of an expensive medicament by its unintended absorption into the hands is undesirable. An applicator capable of reliably dispensing and applying metered dosages is a desirable innovation.

SUMMARY OF THE INVENTION

The present invention provides an applicator for dispensing metered amounts of substances, notably in stick formulations. Such an applicator includes a hollow tube with a piston mounted within the tube. A finger operable means, such as a knob, is mounted at one end of the tube and is mechanically linked to the piston to urge it towards the other end of the tube. Limiting means associated with the finger operable means permits incremental operation of the finger operable means to effect sliding movement of the piston within the tube through corresponding limited increments of travel towards the opposite end of the tube.

The applicator may be used in combination with a column or pillar of meltable formulation which is disposed between the piston and the second end of the tube and conforms in cross sectional shape to the interior cross sectional shape of the tube. Alternately, the tube may be charged with a flowable cream or liquid for discharge through a nozzle, foaming head or other device associated with the second, or discharge end of the tube.

In a typical embodiment, a finger operable base is rotatably mounted in association with the first end of a hollow tube. The base is linked to the piston, e.g. through an inclined plane device, so that rotation of the base effects a longitudinal advance of the piston away from the base. A registration mechanism associated with the base releasably locks the base in one or more fixed positions with respect to an axis of rotation. This mechanism is operated to release the base so that it can rotate a preselected amount, whereupon the mechanism functions to again lock the base against further rotation. In certain embodiments, means are provided to signal an increment of rotation corresponding to a portion of the rotation permitted between successive operations of the registration mechanism.

In a preferred embodiment of the invention, the hollow tube is cylindrical in shape. The piston is then circular in cross section and is connected to the threads of a screw member which is in turn connected to a circular base rotatably mounted at the first end of the tube. When the base is rotated the screw rotates to urge movement of the piston towards the second end of the tube. A depressible button is preferably connected to the base and is formed to extend outside the perimeter of the tube to elastically deform inward of the perimeter upon depression.

An extension is associated with the button and is disposed within the tube to associate with a race connected to the inside of the tube and having a plurality of detents which receive and register with the extension. At least one of the detents is preferably sized to firmly receive the extension so that the base is precluded from rotation unless the depressible button is depressed inward. A hard stop is therefore provided each time the extension registers with a firmly receiving detent.

In a specific embodiment of a stick formulation, the applicator and the concentration of the active ingredient in a meltable formulation are adapted so that a proper single dosage of the medicament is extended beyond the second end of the tube for a predetermined number of register positions. The user may then use the amount of stick formulation extended beyond the second end of the tube. When the formulation is flush with the second end of the tube, the user recognizes that a single treatment has been completed. In a preferred embodiment, a proper single dosage is provided between each hard stop of the register means, preferably located at each 360° of rotation of the base. A cap may also be detachably connected to the second end to protect the stick formulation from the environment. This cap is preferably transparent and has a plurality of markings to indicate when certain incremental amounts of formulation have been extended out of the tube. Preferably, each marking corresponds to the amount of medicament extended between each hard stop.

DETAILED DESCRIPTION OF THE PREFERRED EMBODIMENTS

Figure 1:
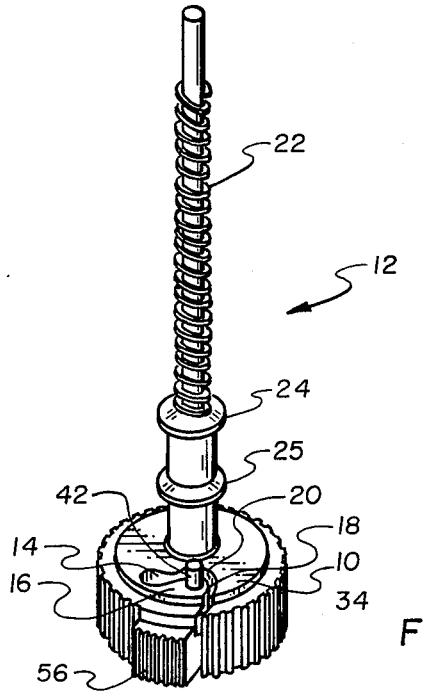
FIG. 1 is a perspective view of a base and stem assembly of the invention.

Referring to FIG. 1, a base and screw member assembly of the invention includes a generally cylindrical base 10 connected to a stem or screw member 12. The base 10 and screw member 12 are preferably of one piece construction and formed of elastically deformable plastic. A curved slot 14 is formed in base 10. Thumb piece 16, formed in base 10, is depressible inward to elastically deform to bring surface 18 proximal to or in contact with surface 20. Because base 10 is formed of elastically deformable material, thumb piece 16, when not depressed inward, tends to return to its non-deformed position shown in FIG. 1.

Figure 2:
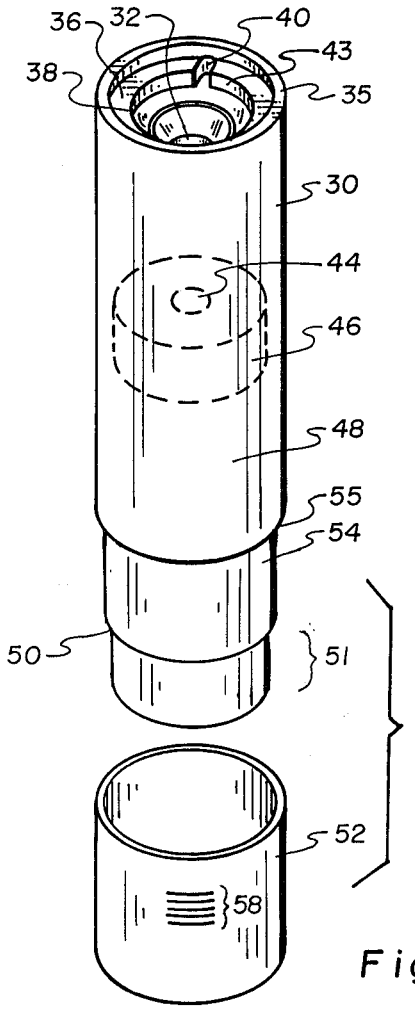
FIG. 2 is an inverted perspective view of a tube and cap of the invention.

Screw member 12 is an inclined plane device having threads 22 and flanges 24 and 25. The base and screw member assembly of FIG. 1 are adapted to be connected to the tube in FIG. 2. The tube of FIG. 2 is shown in inverted position in relation to base 10 of FIG. 1. To be connected to the base and screw member assembly of FIG. 1, tube 30 is inverted 180° from its position in FIG. 2 and placed upon the base and screw member assembly of FIG. 1 in such a way that the screw member 12 is placed within cylindrical hole 32 and so that annular notch 34 formed in base 10 registers with the circular end 35 of tube 30. As screw member 12 is placed within hole 32, flange 24 elastically deforms to pass inward of hole 32 into the interior of tube 30. Flange 24 is then biased against the inside surface of hole 32 and flange 25 is biased against the outside of hole 32 to hold screw member 12 and base 10 in registration with tube 30.

Race 36 is formed within and connected to tube 30, as shown, and is preferably formed in one piece construction with tube 30. Race 36 has a plurality of small detents 38, only one of which is visible in FIG. 2. Race 36 also has a single large detent 40. Cylindrical post 42 is connected to thumb piece 16 of base 10 and together form a resilient registration member. The post serves as an extension of button piece 16 which rides along cylindrical face 43 of race 36. Post 42 and race 36 are sized and configured so that when base 10 is assembled with tube 30 as described, face 43 biases post 42 to elastically deform thumb piece 16 inward (toward screw number 12). This deformation causes thumb piece 16 to naturally tend to deform outward again to effect registration between post 42 and detents 38 or 40.

Screw member 12, at threads 22, registers with hole 44 of piston 46. Cup shaped piston 46 is disposed within and slidingly associates with the interior of tube 30. Formulation 48 is contained within and conforms to the interior shape of tube 30 and is longitudinally disposed between piston 46 and circular orifice 50 of tube 30. As base 10 is rotated clockwise upon tube 30, threads 22 urge piston 46 toward circular orifice 50 to extend a corresponding amount of formulation 48, such as the amount marked 51 out of tube 30. Cup shaped cap 52 connects with tube 30 at cylindrical face 54 in abutment with annular shoulder 55, to protect formulation 48 from the environment.

As base 10 is rotated upon tube 30, post 42 registers with detents 38 and 40 in sequence. When post 42 registers with one of the detents 38, a slight clicking sound may be heard and the user may feel a slight resistance to further movement and/or a vibration through tube 30 or base 10. This slight resistance or vibration may be referred to as a "soft stop." When post 42 comes into registration with detent 40, the base 10 is precluded from further rotation and a "hard stop" is thus provided. The registration member is thus placed in a first position In order to disengage post 42 from detent 40, the user places a thumb or finger on ridged surface 56 to depress extension 16 inward toward screw member 12. Detent 40 may itself be considered a hard stop. Registrations between post 42 and detents 38 or 40 therefore indicate incremental extensions of formulation 48 from tube 30 at circular orifice 50.

A plurality of markings 58 are formed on cap 52 to correspond to various metered amounts of formulation 48 extended beyond orifice 50. For example, each marking may correspond to the amount of formulation 48 extended corresponding to each of the detents 38 or 40. The markings 58 preferably correspond only to the formulation 48 extended corresponding to registration between post 42 and detent 40.

Figure 3:
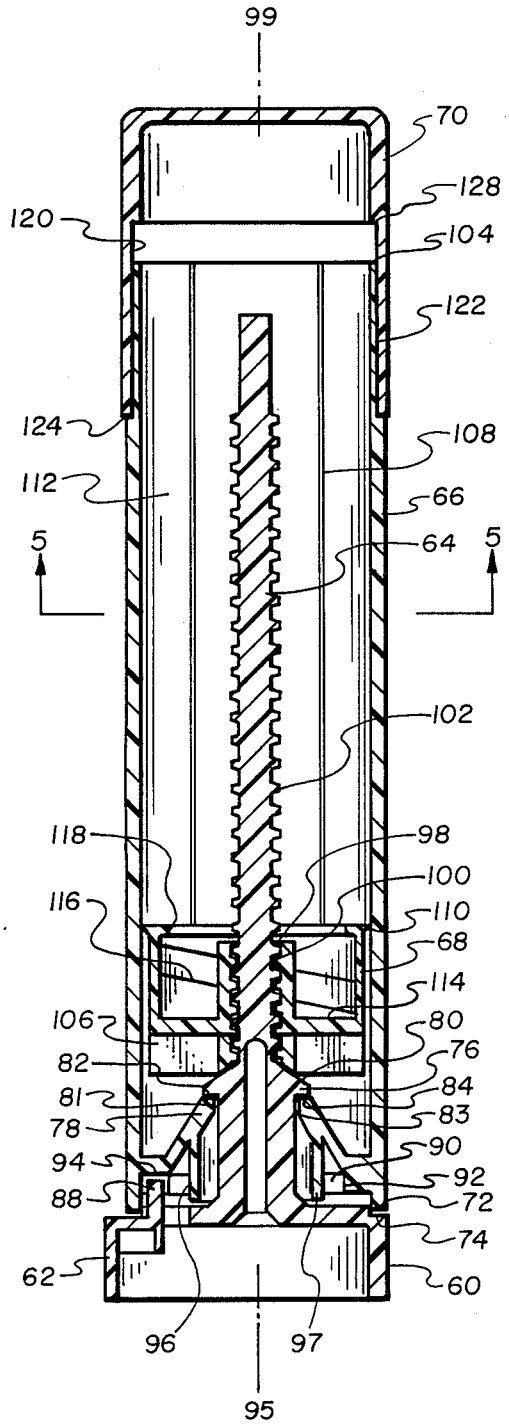
FIG. 3 is a side sectional view of an alternative embodiment an applicator of the invention.
Figure 5:
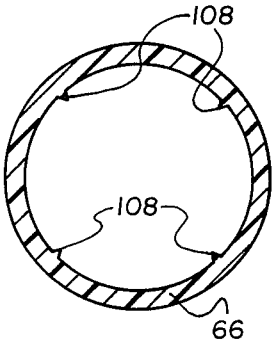
FIG. 5 is a sectional view of tube 66 of FIG. 3 taken along line V—V of FIG. 3.
Figure 4:
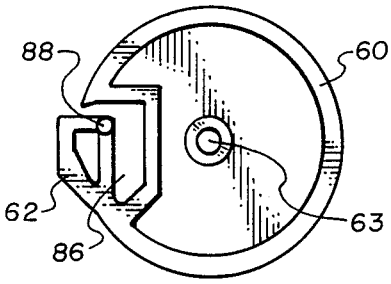
FIG. 4 is a bottom plan view of a base member of the invention.
Figure 4A:
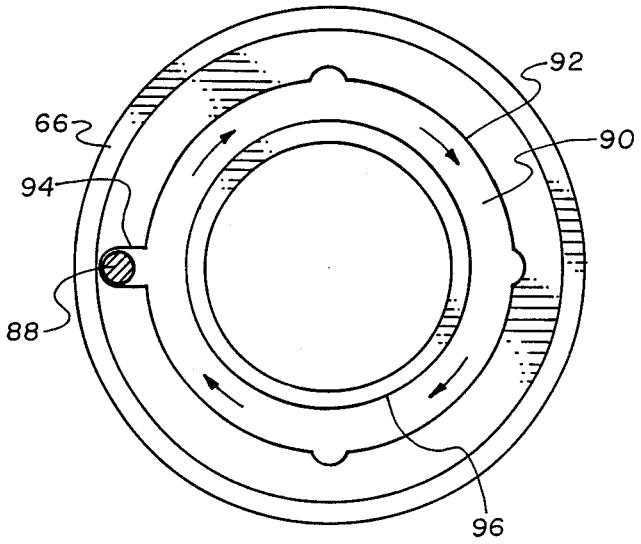
FIG. 4*a* is a schematic view of a race and post assembly of the invention.

FIGS. 3 through 5 illustrate an alternative embodiment of an applicator which functions in similar fashion to the applicator illustrated in FIGS. 1 and 2. The applicator includes a base 60 having a connected thumb piece 62, a stem 64, a body tube 66, a piston 68, and a transparent cap 70. Annular notch 72 formed in base 60 registers with the circular end 74 of tube 66 as shown, to allow base 60 to rotatably associate with tube 66 about axis 99. Base 60 firmly connects to tube 66 through registration between deformable flange 76 of base 60 and deformable housing 78 of tube 66. To be connected to tube 66, flange 76 is pressed inward into tube 66 until ramped surface 80 of flange 76 elastically deforms inward and housing 78 deforms outward. When flange 76 reaches its position shown in FIG. 3, flange 76 and housing 78 snap back to their non-deformed positions shown in FIG. 3. Surfaces 81 and 82 of housing 78 register with surfaces 83 and 84 respectively of base 60 to maintain base 60 in registration with tube 66 in its position shown in FIG. 3.

FIG. 4 is a bottom plan view of base 60. Base 60 has a channel 86, which corresponds to channel 14 in FIG. 1. Base 60 is formed of elastically deformable plastic, so that thumb piece 62 may be elastically deformed inward toward the center 63 of base 60. Referring now again to FIG. 3, post 88 of base 60 may register with channel 90 of tube 66. Surface 92 of channel 90 serves as a race upon which post 88 rides. Race 92 contains a plurality of detents similar to the detents 38 in FIG. 2. Race 92 also has a large detent 94, corresponding to detent 40 of FIG. 2. When post 88 is in registration with detent 94 as shown in FIG. 3, base 60 and thumb piece 62 are in their non-elastically deformed position shown in FIG. 4. To be brought into registration with channel 90, thumb piece 62 must be depressed to elastically deform inward into channel 90, at which point base 60 is free to rotate relative to tube 66 about axis 95.

After post 88 is rotated away from channel 94, post 88 may register with race 92. Because base 60 is formed of elastically deformable material, thumb piece 62 is biased outward to urge post 88 against race 92, to cause post 88 to tend to move into registration with detents formed in race 92.

Small detents, such as detent 38 of FIG. 2 may also be formed in the interior face 96 of cylindrical extension 97 which is formed in tube 66. Post 88 will register with detents formed in face 96 of cylindrical extension 97 when the user depresses thumb piece 62 inward against face 96 and holds thumb piece 62 in its inner position while rotating tube 66.

Piston 68 is sized and configured for placement within tube 66 and for movement within tube 66 longitudinally along axis 95. Piston 68 registers with stem 64 at cylindrical channel 98 of piston 68 which has interior threads 100 (schematically illustrated) which register with exterior threads 102 (schematically illustrated) of stem 64. When base 60 is rotated relative to tube 66, threads 102 of stem 64 urge piston 68 towards annular orifice 104 of tube 66. Piston 68 has a plurality of fins 106 which serve to stabilize piston 68 and preclude it from jamming within the interior of tube 66.

A plurality of longitudinal ribs 108 are formed within tube 66, as more clearly shown in FIG. 5. Piston 68 has an annular exterior flange 110 which registers with the interior of tube 66. Piston 68 is formed of an elastically deformable material such as a soft polyethylene. Therefore, flange 110 elastically deforms inward where it registers with ribs 108. The registration between flange 110 and ribs 108 precludes piston 68 from rotating about axis 95 as piston 68 is biased by stem 64 longitudinally along axis 95.

A medicated formulation 112 in stick form is disposed within tube 66 between surface 114 of piston 68 and orifice 104 of tube 66. A spiraled rib 116 is formed within piston 68 above the interior surface of piston 68 to engage with and aid in holding formulation 112 within piston 68. Annular ridge 118 formed in piston 68 also engages with formulation 112 to aid in holding formulation 112 within piston 68.

As shown in FIG. 3, cap 70 engages with tube 66. A cylindrical face 120 is formed in cap 70 as shown. Face 120 registers with a generally cylindrical face 122 of tube 66. Face 122 is tapered approximately 1° so that face 122 slopes inward from annular shoulder 124 to orifice 104. This slight sloping aids in the placement of cap 70 on tube 66 and also serves to increase frictional resistance between cap 70 and tube 66 as cap 70 is slid onto tube 66 to eventually make contact with annular shoulder 124. Annular shoulder 128 formed in transparent cap 70 serves as a visual marking to indicate to the user when a single dosage of medicament 112 has been extended beyond orifice 104 of tube 66.

As base 60 is rotated clockwise, piston 68 is urged toward orifice 104. Piston 68 therefore urges a corresponding amount of medication out of tube 66 beyond orifice 104. When base 60 has undergone a complete 360° rotation about axis 95, post 88 again comes into registration with detent 94. At this time enough medicament has been extended beyond orifice 104 to come into alignment with annular shoulder 128 in cap 70. The user thus has a system for double checking whether a proper single dosage has been extended. Both the registration of post 88 with detent 94 and the visual indication of medicament 112 being in line with shoulder 128 indicate to the user that a proper single dosage has been extended for use.

If amounts less than a single dosage are desired to be extended beyond the orifice 104, registration between post 88 and smaller detents indicate to the user when certain portions of the full dosage have been extended. Such smaller dosages may be useful, for example, when the user needs to apply portions of a single dosage to different parts of his body. For example, if the medicament is intended to stimulate hair growth, and the user has isolated bald spots, the user can use a metered portion of a single dosage on one bald spot and other metered portions of a single dosage on other bald spots so as to apply the medicament where it is most needed. The "hard stop" registration between post 88 and detent 94 ideally signals to the user that a single dosage has been used and that no more medicament should be extended for use in that particular treatment.

Figure 6:
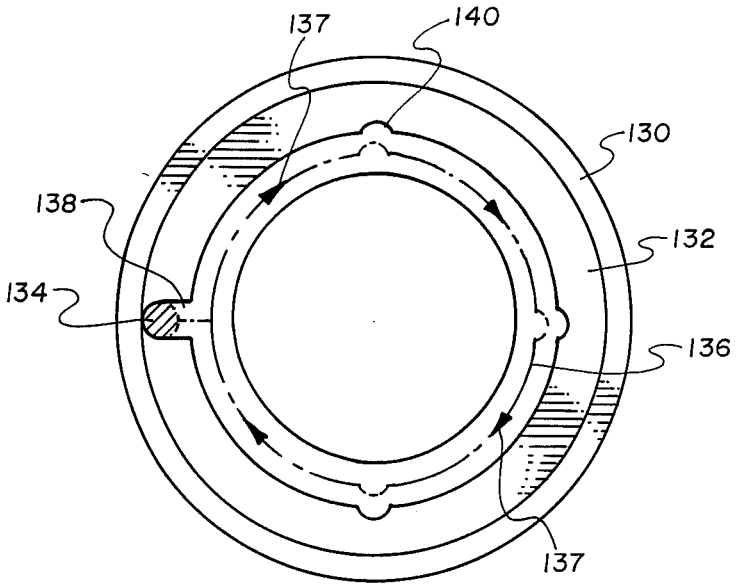
FIG. 6 is a schematic view of a race and post assembly of the invention.

FIG. 6 is a schematic view of a race and post assembly of the invention, and includes a tube 130, race 132, and post 134. Tube 130 of FIG. 6 corresponds, for example, to tube 66 of FIG. 3; race 132 corresponds to race 92; post 134 corresponds to post 88, and channel 136 corresponds to channel 90. Post 134 is connected to an elastically deformable thumb piece (not shown) corresponding to thumb piece 62 of FIG. 3.

As with the embodiment illustrated in FIG. 3, the post 134 is biased inward by the thumb piece so as to come into registration with channel 136. The thumb piece and/or the tube 130 is then rotated so that post 134 moves in the direction indicated by the arrows 137 within channel 136 relative to tube 130. Because the elastically deformable thumb piece tends to bias post 134 against race 132, post 134 tends to come into registration with small detents 140 (providing soft stops) or large detent 138 (providing a hard stop).

Figure 7:
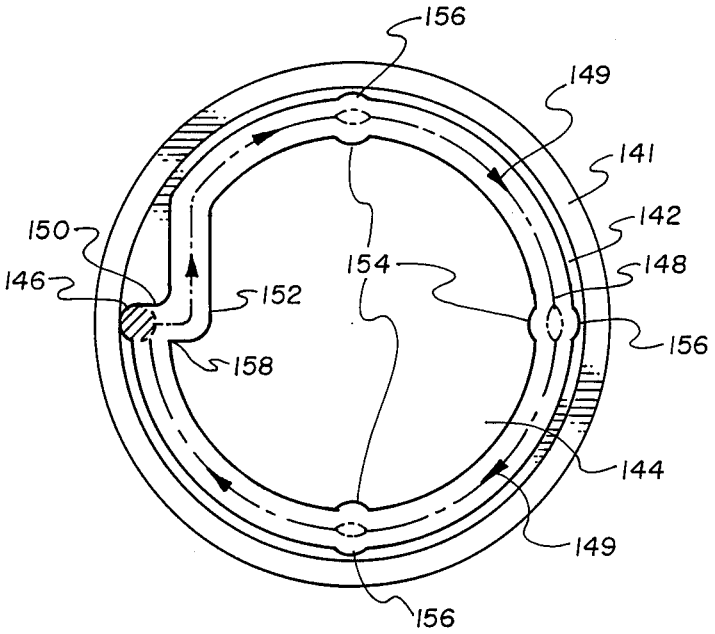
FIG. 7 is a schematic view of an alternative embodiment of a race and post assembly of the invention.

FIG. 7 illustrates an alternative embodiment of a race and post assembly of the invention, and includes a tube 141, outer race 142, inner race 144, post 146, with a channel 148 formed in tube 141. Post 146 moves in the direction indicated by the arrows 149 relative to tube 141 in order for the stem and piston to bias the stick formulation towards the open end of the tube.

As shown in FIG. 7, abutment 150 precludes post 146 from travelling in the direction of the arrows 149. As with the other embodiments, post 146 is biased towards the perimeter of tube 141 by being connected to an elastically deformable thumb pieces. In order to allow post 146 to travel in channel 148 in the direction of the arrows 149, the thumb piece (not shown) must be depressed inward to move post 146 away from abutment 150, in contact with or in proximity to face 152 of inner race 144. As the post 146 is rotated in the direction of arrows 149, should the user fail to release the button piece, ramped surface 152 biases post 146 back towards the perimeter of tube 141.

Should the user continue to press button 146 inward, post 146 will eventually register with small inner detents 154 formed in inner race 144, indicating to the user that certain portions of a full dosage of the medicament have been extended for use. If the user does not continue biasing post 146 inward, the thumb piece will bias post 146 outward to register with small outer detents 156 in outer race 142 as in other embodiments. Should the user continue to bias post 146 inward and rotate post 146 throughout an entire 360° path until post 146 reaches point 158, post 146 will snap at a high rate of speed from point 158 onto surface 152, causing an audible click or physical vibration in tube 141, signalling to the user that a full recommended dosage has been extended beyond the tube.

Thus, the race and post assembly of FIG. 7 provides a system for helping a user avoid using too much of the medicament if he has a tendency to continue depressing the thumb piece inward while rotating the thumb piece or the tube in order to extend medicament beyond the tube. If the user releases the thumb piece once the post 146 is moved out of engagement with abutment 150, post 146 will, after it has undergone a complete 360° path, again come into engagement with abutment 150, to preclude further rotation of the thumb piece or tube. The embodiment of FIG. 7 thus has a safety system for avoiding overdoses.

In certain embodiments, it may be advantageous to forego any hard stop detents relying instead only on soft stops. In other instances, it may be advantageous to incorporate only hard stops. The number and type of registrations used will depend greatly on the characteristics of the particular medicament used, including its potential for and the seriousness of side effects.

Other assemblies providing metered application of medicaments are within contemplation of the present invention. For example, tubes, such as tube 30 or tube 66, of other than circular cross sections maybe advantageous. It may also be advantageous to have an extension, such as post 42 or 88, associated with a tube, and to have a race, such as race 36 associated with a base. Additionally, other methods of providing a depressible button are within contemplation. For example, rather than a button, such as button piece 16 or 62, being biased outward by elastic deformation of the button itself, it may be advantageous to associate a button with another biasing device, such as a spring. Moreover, a nozzle or other dispensing device may be substituted for the cap 70, particularly if it is desirable to dispense a liquid, cream or foam formulation.

Reference herein to details of the illustrated embodiment are not intended to limit the scope of the claims, which themselves recite those features regarded as essential to the invention.

We claim:

1. An applicator for dispensing metered amounts of a substance, comprising:

a hollow tube having a first end, a second end, and a longitudinal axis;

a piston mounted slidingly to move within said to be along said longitudinal axis;

finger operable means at said first end of said tube mechanically linked to said piston to urge sliding movement of said piston towards said second end;

whereby when said substance is placed in said tube abutting said piston, said finger operable means may be operated to urge said piston toward said second end to dispense said substance from said second end; and locking means operatively associated with said finger operable means and including a registration member and at least one registration member hard stop, said locking means having a first position in which the registration member engages with said hard stop to prohibit operation of said finger operable means and thus sliding movement of said piston, said registration member being resiliently biased in a direction to engage said hard stop, said locking means further having a second position to permit operation of said finger operable means and thus sliding movement of said piston, said second position resulting from the user moving said registration member in a direction opposite its biasing away from said hard stop, said locking means being adapted to be operable by the fingers of a user.

2. An applicator according to claim 1 in combination with a column of meltable formulation, said column being disposed between said piston and said second end of said tube and conforming in cross sectional shape to the interior cross sectional shape of said tube, wherein said tubes piston, finger operable means, and locking means are cooperatively adapted to extend incremental amounts of said formulation out of said tube at said second end upon operation of said finger operable means, each of said incremental amounts corresponding to operation of said finger operable means between each of said hard stops.

3. An applicator according to claim 2 in combination with a transparent cap detachably connected to said second end of said tube and said cap having a longitudinal axis parallel to the longitudinal axis of said tube, and said cap including a plurality of longitudinally spaced markings on a side of said cap to indicate when ne of said incremental amounts of said formulation is extended out of said tube.

4. An applicator according to claim 1, wherein so finger operable means includes a base rotatably mounted to said first end of said tube.

5. An applicator according to claim 4, wherein said base is linked to said piston by means of a screw member attached to said base.

6. An applicator according to claim 5, wherein said locking means includes:

said registration member being movably connected to said base; and a race associated with said tube, wherein said race includes a plurality of detents, said registration member adapted to register in series with said detents, wherein at least one of said detents is configured and adapted to register with said registration member to provide a said hard stop at each 360? rotation of said base.

7. An applicator for dispensing metered amounts of a substance, comprising:

a hollow tube having a first end, a second end, and a longitudinal axis;

a piston mounted to slidingly move within said tube along said longitudinal axis;

a screw member mounted within said tube and mechanically linked with said piston;

a base rotatably mounted at said first end of said tube and mechanically connected to said screw, said piston, screw and base being cooperatively adapted to rotate said screw to urge sliding movement of said piston towards said second end upon rotation of said base;

an operable registration assembly mechanically associated with said base, said registration assembly and said tube being cooperatively adapted to provide at least one registration position upon rotation of said base;

a column of meltable formulation, said column being disposed between said piston and said second end of said tube and conforming to the interior cross-sectional shape of said tube, wherein said tube, piston, screw member, and bases are cooperatively adapted to extend incremental amounts of said formulation out of said tube at said second end upon rotation of said base; and a transparent cap detachably connected to said second end of said tube and having a longitudinal axis parallel to the longitudinal axis of said tube, said cap including a plurality of longitudinally spaced markings on a side of said cap to indicate when said incremental amounts of said formulation have been extended beyond said second end.

8. An applicator according to claim 7, wherein said registration assembly is comprised of:

a registration member movably connected to said base; and a race associated with said tube, wherein said race contains a detent formed in said race such that said registration member registers with said detent with said registration member in a first position in which said base is precluded from rotation and a second position in which said registration member is out of registration with said detent to permit said base to rotate;

wherein said registration member is adapted to be movable by the fingers of a user between said first and second position.

9. An applicator for dispensing metered amounts of a substance, comprising:

a hollow tube having a first end, a second end, and a longitudinal axis;

a piston mounted to slidingly move within said tube along said longitudinal axis of said tube;

a screw member rotatably mounted within said tube with threads mechanically engaged with said piston to urge movement of said piston towards said second end upon rotation of said screw member;

a base rotatably mounted at said first end of said tube and connected to said screw to cause rotation of said screw upon rotation of said base;

whereby when said substance is placed in said tube abutting said piston, said base may be rotated to urge said piston toward said second end to dispense said substance from said second end;

a depressible button connected to said base and formed to extend outward of the perimeter of said tube and formed to elastically deform inward of said perimeter upon depression;

a registration member associated with said button and disposed within said tube; said a race associated with interior of said tube proximal said first end and adapted to have at least one detent to receive and register with said registration member upon rotation of said base, and wherein said registration member is out of registration with said detent when said button is depressed.

10. An applicator according to claim 9, wherein said depressible button is formed in one-piece construction with said base.

11. An applicator according to claim 9, wherein said detent is sized and adapted such that when said registration member is in registration with said at least one detent, said detent blocks further rotational movement of said base to provide at least one hard stop at each 360° rotation of said base in which rotation of said base is precluded unless said button is depressed.

12. An applicator according to claim II, in combination with a column of meltable formulation, said column being disposed between said piston and said second end and conforming in cross sectional shape to the interior cross sectional shape of said tube, wherein said tube, piston, screw member, and base are cooperatively adapted to extend incremental amounts of said formulation out of said tube at said second end.

13. An applicator according to claim 9 in combination with a transparent cap detachably connected to said tube at said second end, said cap having a longitudinal axis parallel to the longitudinal axis of said tube and having a plurality of longitudinally spaced markings on a side of said cap to indicate when pre-determined incremental amounts of said formulation have been extended out of said tube.

14. An applicator according to claim 11, wherein said tube, said meltable formulation, and the rotational distance between registrations of said registration member with said detent, are mutually adapted to provide a preselected amount of said formulation.

15. An applicator according to claim 14, wherein said formulation contains a drug with disadvantageous side effects in dosages greater than said single dosage.

16. An applicator according to claim 15, wherein said formulation contains the drug Minoxidil.

* * * * *

UNITED STATES PATENT OFFICE

CERTIFICATE OF CORRECTION

Patent No. 4,865,480 Dated SEPTEMBER 12, 1989

Inventor(s) VALDON G. REYNOLDS, STEVEN M. WOOD, JOSEPH T. SORENSON

It is certified that error appears in the above-identified patent and that said Letters Patent is hereby corrected as shown below:

In column 1, line 34, delete "minoxidil" and insert --Minoxidil--.

In column 4, line 10, delete "The registration member is thus placed in a first position".

In claim 1, line 42, delete "to be" and insert --tube--.

In claim 2, line 6, delete "tubes" and insert --tube,--.

In claim 3, line 18, delete "ne" and insert --one--.

In claim 6, line 36, delete "360?" and insert --360°--.

Signed and Sealed this

Fourth Day of September, 1990

*Attest:*

HARRY F. MANBECK, JR.

*Attesting Officer*

*Commissioner of Patents and Trademarks*